US009908155B2

(12) United States Patent
Smith et al.

(10) Patent No.: US 9,908,155 B2
(45) Date of Patent: Mar. 6, 2018

(54) VACUUM POWERED SURFACE CLEANING APPARATUS

(71) Applicants: Jonathan William Smith, Nepean (CA); Hugh Hunter Chant, Lyn (CA); Matthew William Smith, Algonquin (CA)

(72) Inventors: Jonathan William Smith, Nepean (CA); Hugh Hunter Chant, Lyn (CA); Matthew William Smith, Algonquin (CA)

( * ) Notice: Subject to any disclaimer, the term of this patent is extended or adjusted under 35 U.S.C. 154(b) by 208 days.

(21) Appl. No.: 14/824,279

(22) Filed: Aug. 12, 2015

(65) Prior Publication Data

US 2017/0042397 A1 Feb. 16, 2017

(51) Int. Cl.

| | |
|---|---|
| ***B08B 5/04*** | (2006.01) |
| ***B08B 3/02*** | (2006.01) |
| ***B08B 15/04*** | (2006.01) |

(52) U.S. Cl.

CPC ..... *B08B 3/02* (2013.01); *B08B 5/04* (2013.01); *B08B 15/04* (2013.01); *B08B 2203/0229* (2013.01)

(58) Field of Classification Search

CPC ..... A47L 11/03; A47L 11/408

See application file for complete search history.

(56) References Cited

U.S. PATENT DOCUMENTS

| | | | | |
|---|---|---|---|---|
| 4,534,083 | A * | 8/1985 | Hampson | A47L 11/34 137/892 |
| 4,673,006 | A * | 6/1987 | Speck | B08B 9/0933 137/892 |
| 5,181,348 | A * | 1/1993 | Roemmele | B24C 3/065 451/75 |
| 5,893,519 | A * | 4/1999 | Cavaretta | A62C 31/12 239/318 |
| 6,505,379 | B2 * | 1/2003 | Keller | A47L 9/02 15/339 |
| 7,788,765 | B2 * | 9/2010 | Allen | A47L 5/14 15/345 |
| 2015/0300376 | A1 * | 10/2015 | Eidmohammadi | F04F 5/02 417/84 |

* cited by examiner

*Primary Examiner* — Sarah B McPartlin

(57) ABSTRACT

A vacuum powered surface cleaning apparatus which is capable of cleaning an adjacent surface to remove debris without external leaking, dripping or misting. The vacuum powered surface cleaning apparatus includes an eductor assembly to create a vacuum within the device to naturally induce a flow of cleaning fluid which is imparted onto the adjacent surface to be cleaned. The expended cleaning fluid and debris are expelled from the apparatus through the eductor to external atmosphere or to an external waste or recycling container. Removal of the adjacent surface opens the internal chamber which causes a loss of partial vacuum which ceases flow of cleaning fluid, thereby eliminating the possibility of external dripping or misting.

3 Claims, 1 Drawing Sheet

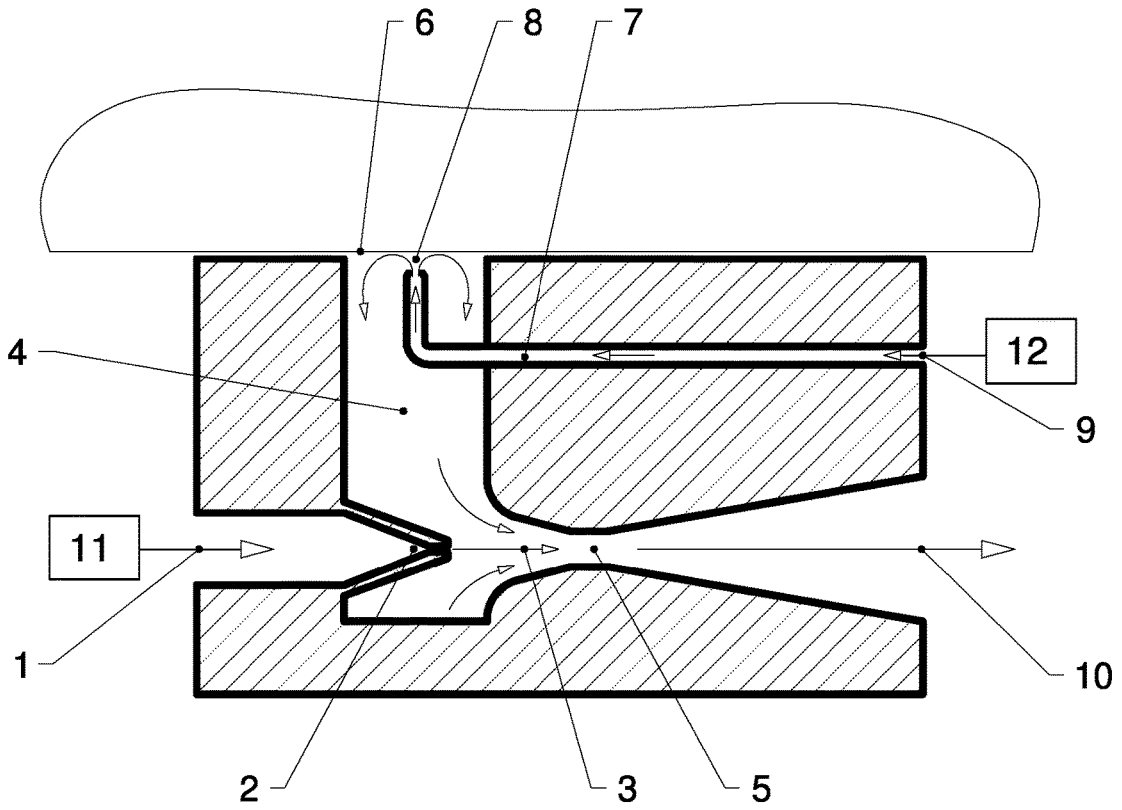
6
8
7
4
12
9
11
1
10
2
3
5

VACUUM POWERED SURFACE CLEANING APPARATUS

CROSS-REFERENCE TO RELATED APPLICATION

Not Applicable

BACKGROUND OF INVENTION

This invention pertains to surfaces in industry which are required to be cleaned by flushing and/or diluting with a cleaning fluid, without risk of dripping or misting.

Existing technologies fail to meet the full performance of the present invention for any or all of the following reasons: The use of pumps or other pressure devices to induce a flow of cleaning fluid will contribute to dripping or misting outside of the cleaning apparatus. Low flow pumping systems do not introduce cleaning fluid in sufficient volume or with sufficient energy to flush debris from the surface being cleaned. Gravity cleaning systems do not adequately remove expended cleaning fluid and debris from the surface being cleaned.

BRIEF SUMMARY OF THE INVENTION

The subject invention is a device which allows for efficient and hygienic fluid cleaning of a surface without dripping or misting and without the need for external cleaning fluid pumping. The adjacent surface to be cleaned must be present in order to enclose the vacuum chamber and in order to induce cleaning fluid flow. Once the adjacent surface is removed, the static vacuum dissipates and cleaning fluid no longer flows. This design approach allows for high flow of cleaning fluid for aggressive and rapid cleaning without the risk of fluid or debris leaving the apparatus.

BRIEF DESCRIPTION OF DRAWING VIEWS

FIG. 1: Cross section of the Vacuum Powered Surface Cleaning Apparatus

DETAILED DESCRIPTION OF THE INVENTION

Referring now in detail to FIG. 1, numbered features are described as follows: 11 is a compressed air source. 1 is a connection point for a compressed air supply. 2 is a nozzle which converts high static pressure air into low static pressure, high dynamic pressure air. 3 is the ejected air stream. 4 is the enclosed partial-vacuum chamber which may be integral as shown or may be a duct of any length and shape. 5 is the eductor throat which creates the chamber vacuum by entraining fluid from the chamber with the stream of lower static pressure air from the nozzle. 6 is the independent adjacent surface to be cleaned. 7 is the channel for introducing cleaning fluid. 8 is the zone of the surface being cleaned by the fluid and vacuum. 12 is a cleaning fluid source. 9 is the channel through which cleaning fluid is naturally drawn by the vacuum in the enclosed partial vacuum chamber. 10 is the downstream outlet where expended air, cleaning fluid and other debris are expelled to atmosphere or to a waste container or to a recycle container for cleaning fluid reuse.

The apparatus can be constructed with any size and external geometry to conform to the adjacent surface being cleaned, whether that adjacent surface is planar, curved or of an irregular shape.

The apparatus can function statically or dynamically relative to the adjacent surface being cleaned.

Items 2 and 5, as shown in FIG. 1, form an 'eductor' which is existing technology, well established in industry. However, the size and geometry of items 2 and 5, as shown in FIG. 1, must be properly proportioned to suit the overall requirements for vacuum level and flow rates of compressed air and cleaning fluid. That tuning is specific to each application, but could easily be performed using established principles of fluid dynamics.

The materials of construction of the apparatus are not restricted, provided that they are structurally sturdy enough to perform as intended, and compatible with the cleaning fluid and other matter flowing through the apparatus.

The invention claimed is:

1. A vacuum powered surface cleaning apparatus comprising:

an enclosed partial vacuum chamber adapted to abut an adjacent surface to be cleaned;

an eductor assembly comprising:

an air nozzle;

an eductor throat; and an eductor outlet;

a connecting duct which connects the eductor assembly to the enclosed partial vacuum chamber;

a compressed air supply; and a cleaning fluid supply comprising:

an external cleaning fluid source; and a cleaning fluid flow channel;

wherein the compressed air supply passes through the air nozzle and is converted from a high static pressure air stream to an ejected low static pressure and high dynamic pressure air stream, and the ejected low static pressure and high dynamic pressure air stream enters the eductor throat inducing a low static pressure within the connecting duct and enclosed partial vacuum chamber which induces a flow of cleaning fluid from the cleaning fluid source and through the cleaning fluid flow channel and is adapted to impart the flow of cleaning fluid onto the adjacent surface to be cleaned, and expended cleaning fluid together with dislodged debris are expelled from the partial vacuum chamber through the connecting duct and through the eductor and through the eductor outlet.

2. The vacuum powered surface cleaning apparatus of claim 1, wherein the enclosed partial vacuum chamber is adapted to abut an adjacent surface of any shape including planar, contoured or irregular.

3. The vacuum powered surface cleaning apparatus of claim 1, wherein absence of the abutted adjacent surface causes the partial vacuum chamber to become open to atmosphere which ceases the induced flow of cleaning fluid from the cleaning fluid source and cleaning fluid channel.

* * * * *